US008079306B2

(12) United States Patent
Kaeser

(10) Patent No.: US 8,079,306 B2
(45) Date of Patent: Dec. 20, 2011

(54) APPARATUS AND METHOD FOR CLEANING GUIDE ROLLERS OF A PRINTING UNIT

(75) Inventor: Wolfgang Kaeser, Mertingen (DE)

(73) Assignee: Man Roland Druckmaschinen AG, Augsburg (DE)

( * ) Notice: Subject to any disclaimer, the term of this patent is extended or adjusted under 35 U.S.C. 154(b) by 304 days.

(21) Appl. No.: 12/043,043

(22) Filed: Mar. 5, 2008

(65) Prior Publication Data

US 2008/0216694 A1 Sep. 11, 2008

(30) Foreign Application Priority Data

Mar. 6, 2007 (DE) ..... 10 2007 010 761

(51) Int. Cl.
*B41F 35/00* (2006.01)

(52) U.S. Cl. ..... 101/424; 101/423

(58) Field of Classification Search ..... 101/424, 101/423

See application file for complete search history.

(56) References Cited

U.S. PATENT DOCUMENTS

| | | | | | |
|---|---|---|---|---|---|
| 2,852,797 | A | * | 9/1958 | Daubenspeck | 15/244.1 |
| 3,080,594 | A | * | 3/1963 | Race | 15/210.1 |
| 3,467,011 | A | * | 9/1969 | Bloechl et al. | 101/425 |
| 3,647,621 | A | | 3/1972 | Schiel | |
| 4,281,595 | A | * | 8/1981 | Fujishiro | 101/177 |
| 4,467,719 | A | * | 8/1984 | Grosshauser | 101/221 |
| 4,488,483 | A | * | 12/1984 | Kohara | 101/178 |
| 5,333,347 | A | * | 8/1994 | Stranders | 15/220.1 |
| 5,542,352 | A | * | 8/1996 | Blackman et al. | 101/483 |
| 5,598,596 | A | * | 2/1997 | Jones et al. | 15/1.52 |
| 5,953,784 | A | * | 9/1999 | Suzuki et al. | 15/209.1 |
| 6,944,907 | B2 | * | 9/2005 | Lynn | 15/257.1 |

FOREIGN PATENT DOCUMENTS

DE 101 14 347 A1 9/2002

* cited by examiner

*Primary Examiner* — Anthony Nguyen
(74) *Attorney, Agent, or Firm* — Crowell & Moring LLP

(57) ABSTRACT

An apparatus and method for cleaning guide rollers of a printing unit, particularly a 9-cylinder satellite printing unit, of a web-fed printing press, is disclosed. A cleaning device having a cleaning body fastened to an actuating grip is insertable between the guide rollers of the printing unit. A cleaning cloth that can be wetted with cleaning fluid can be fastened to the cleaning body, and the cleaning body features cleaning surfaces on opposing sides that are adapted to the contour of the guide rollers.

10 Claims, 2 Drawing Sheets

APPARATUS AND METHOD FOR CLEANING GUIDE ROLLERS OF A PRINTING UNIT

This application claims the priority of German Patent Document No. 10 2007 010 761.9, filed Mar. 6, 2007, the disclosure of which is expressly incorporated by reference herein.

BACKGROUND AND SUMMARY OF THE INVENTION

The invention relates to an apparatus and method for cleaning guide rollers of a printing unit, in particular of a 9-cylinder satellite printing unit of a web-fed printing press.

Printing units of web-fed printing presses known from practice have several printing couples, wherein each printing couple features a transfer cylinder, a plate cylinder, an inking system as well as, if applicable, a dampening system. The plate cylinders are also designated as engraving cylinders and the transfer cylinders are also called blanket cylinders. In addition, these types of printing units feature impression cylinders, wherein an impression cylinder can cooperate with one or more transfer cylinders of different printing couples. The impression cylinders are also designated as satellite cylinders, which is why printing units with at least one impression cylinder are also called satellite printing units. In addition to satellite printing units that have impression cylinders, printing units that do not have any impression cylinders are known, wherein, in the case of printing units without impression cylinders, the transfer cylinders of two printing couples roll off one another.

A printing unit of a web-fed printing press that is embodied as a 9-cylinder satellite printing unit has four printing couples and consequently four plate cylinders as well as four transfer cylinders, wherein the transfer cylinders of all four printing couples roll off a common impression cylinder. A total of four print positions are embodied between the impression cylinder and the four transfer cylinders, whereby a to-be-printed printing substrate is conveyed through these print positions to be printed.

Thus, a to-be-printed printing substrate of a first print position of a 9-cylinder satellite printing unit is fed via a feed roller, and a printing substrate printed in such a satellite printing unit is discharged from the satellite printing unit starting from a fourth and thus final print position via a discharge roller. The printed printing substrate thus proceeds off the discharge roller with its print side that has just been printed in the printing unit, whereby there is a danger that printing ink will collect on the discharge roller that will impede transport of the printing substrate in the region of the discharge roller. Therefore, it is necessary to clean at least the discharge roller. Until now no cleaning devices for guide rollers of a printing unit have been known from practice, which permit effective cleaning of the guider rollers, in particular the discharge roller.

Starting herefrom, the present invention is based on the objective of creating a novel satellite cleaning device for guide rollers of a printing unit of a web-fed printing press. The cleaning device according to the invention has a cleaning body fastened to an actuating grip, which body can be inserted between guide rollers of a printing unit, wherein a cleaning cloth that can be wetted with cleaning fluid can be fastened to the cleaning body, and wherein the cleaning body features cleaning surfaces on opposing sides that are adapted to the contour of the guide rollers. Effective cleaning of the guide rollers, particularly the discharge roller, of a printing unit is possible with the inventive cleaning device.

The actuating grip preferably engages on an upper section of the cleaning body, whereby the cleaning surfaces are embodied on a lower section of the cleaning body, and whereby a clamping device is allocated to the upper section of the cleaning body, in order to clamp the cleaning cloth on the cleaning body.

Preferred developments of the invention are yielded from the following description. Without being limited hereto, one exemplary embodiment of the invention is explained in greater detail on the basis of the drawings.

DETAILED DESCRIPTION OF THE DRAWINGS

Figure 1:
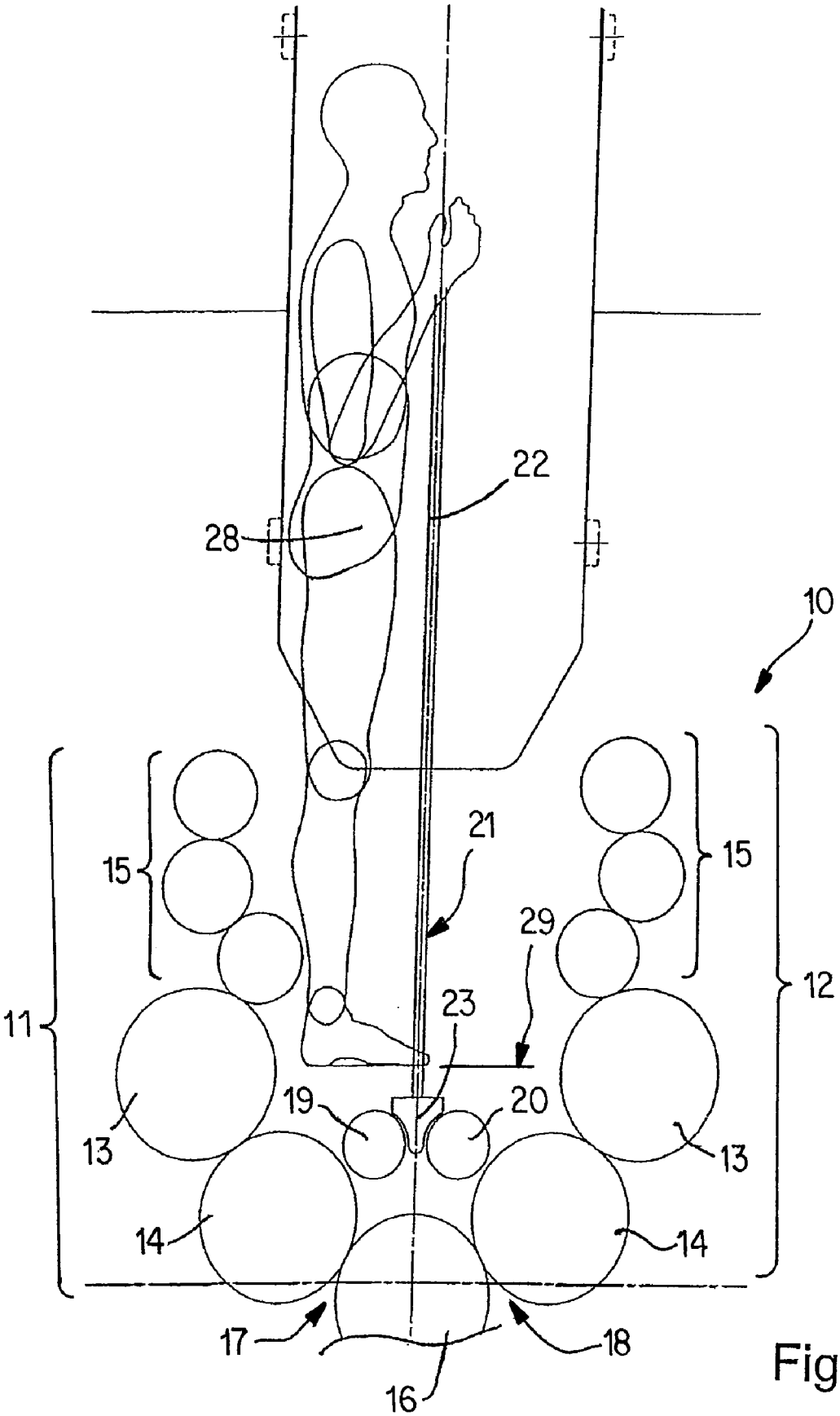
FIG. 1 is a cross-section of a 9-cylinder satellite printing unit together with an inventive cleaning device for the guide rollers of the printing unit.

FIG. 1 shows a cross-section of a printing unit 10 embodied as a 9-cylinder satellite printing unit in the region of two upper printing couples 11, 12, wherein a plate cylinder 13, a transfer cylinder 14 as well as rollers of an inking system 15 are depicted for each of the two upper printing couples 11, 12. The two transfer cylinders 14 of the depicted printing couples 11, 12 roll off a common impression cylinder 16 each forming a nip 17 or 18, whereby a printing substrate can be moved through the nip to be printed.

In order to convey a to-be-printed printing substrate in a defined manner through the print positions of the satellite printing unit 10, the printing unit has two guide rollers, namely a so-called feed roller 19 and a so-called discharge roller 20. A to-be-printed printing substrate is conveyed to the nip 17 via the feed roller 19 and, on the other hand, an already printed printing substrate is discharged from the printing unit 10 via the discharge roller 20 starting from the nip 18. In the process, the side of the printing substrate printed in the printing unit 10 rolls off the discharge roller 20, whereby the discharge roller can get contaminated by deposits of printing ink.

The present invention makes available a cleaning device 21 for cleaning the guider rollers of such a printing unit, particularly for cleaning the discharge roller 20 that is susceptible to contamination. The cleaning device 21 has a cleaning body 23 fastened to an actuating grip 22, which can be inserted between guide rollers 19, 20 of the printing unit 10 as shown in FIG. 1. The cleaning body 23 has cleaning surfaces 24, 25 on opposing sides that are adapted to the contour of the guide rollers 19, 20. In this case, the cleaning surfaces 24, 25 have an identical contour, just like the guide rollers 19, 20 of the printing unit 10 feature identical contours.

Figure 2:
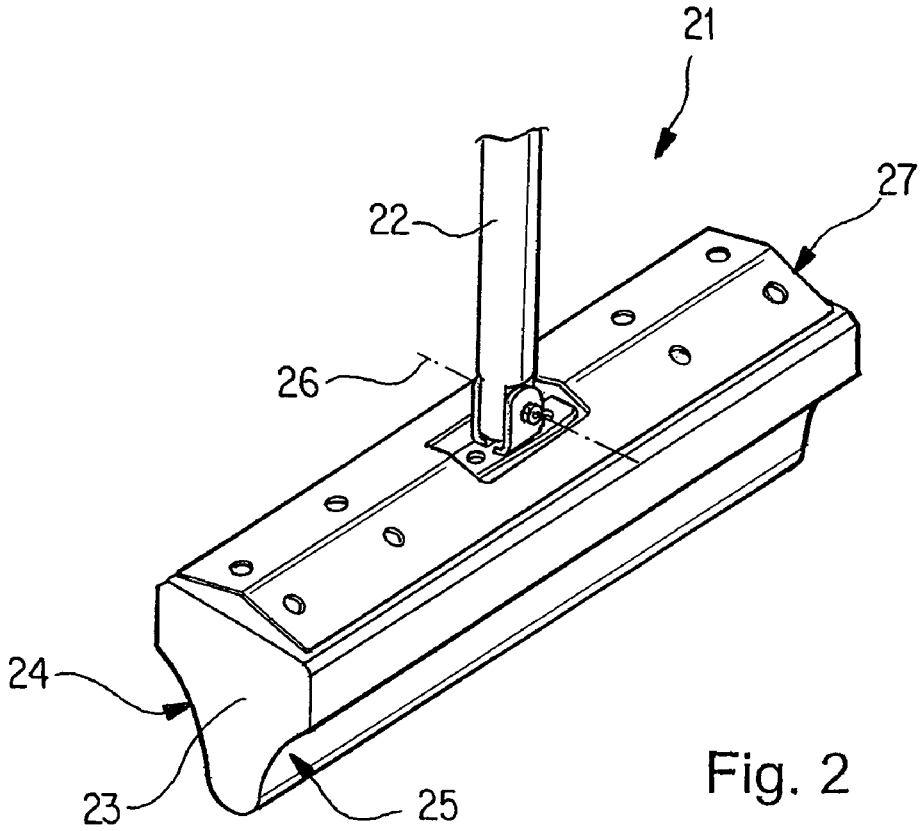
FIG. 2 is a perspective view of a detail of the inventive cleaning device.
Figure 3:
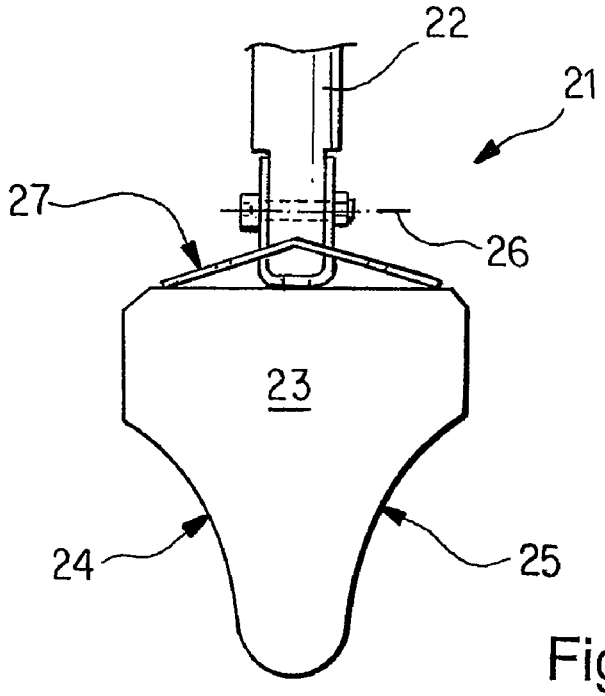
FIG. 3 is a side view of the cleaning device of FIG. 2.

The actuating grip 22 engages on an upper section of the cleaning body 23 in an articulated manner, and the cleaning surfaces 24 and 25 are embodied on a lower section of the cleaning body 23. An axis 26, around which the cleaning body 23 is fastened in an articulated manner to the actuating grip 22, extends perpendicularly to the longitudinal direction of the cleaning body 23 as well as to the longitudinal direction of the cleaning surfaces 24, 25 as shown in FIG. 2.

To clean the guide rollers 19, 20, particularly the discharge roller 20, a cleaning cloth (not shown) that can be wetted with cleaning fluid can be fastened to the cleaning body 23, wherein a clamping device 27 allocated to the upper section of the cleaning body 23 is used for this. A cleaning cloth fastened to the cleaning body 23 with the aid of the clamping device 27 wraps around the cleaning body 23 in its longitudinal direction in such a way that the cleaning cloth covers the cleaning surfaces 24, 25 that are adapted to the contour of the guide rollers.

According to FIG. 1, to clean the guide rollers 19, 20 of the printing unit 10, the cleaning device 21 with its cleaning body 23, on which the cleaning cloth wetted with cleaning fluid is fastened, can be inserted from above between the guide rollers 19, 20.

In a first cleaning step, a first cleaning surface 24 is adjacent to the feed roller 19 and a second cleaning surface 25 is adjacent to the discharge roller 20, wherein by executing a swivel motion with the actuating grip 22, the cleaning body 23 can be moved in this position over the entire axial extension of the guide rollers 19, 20. This first cleaning step is used to loosen the contamination on the discharge roller 20.

Then the cleaning body 23 of the cleaning device 21 is pulled out from between the guide rollers 19, 20, rotated 180° and then re-inserted between the two guide rollers 19, 20 so that for a second cleaning step after rotating the cleaning device 21, the first cleaning surface 24 of the cleaning body 23 is adjacent to the discharge roller 20 and the second cleaning surface 25 is adjacent to the feed roller 19. During this second cleaning step, the already loosened contamination can be removed from discharge roller 20. In this case as well, the cleaning body 23 is moved along the entire axial extension of the guide rollers 19, 20 via the actuating grip 22.

The inventive cleaning device 21 is used accordingly to manually clean the guide rollers 19, 20, whereby according to FIG. 1, an operator 28, who actuates the cleaning device 21, stands on a foot plate 29 above the guide rollers 19, 20. In this standing position, the operator 28 can use the cleaning device 21 to effectively clean the guider rollers 19, 20 of the printing unit 10, particularly the discharge roller 20 that is susceptible to contamination.

LIST OF REFERENCE NUMERALS

10 Printing unit
11 Printing couple
12 Printing couple
13 Plate cylinder
14 Transfer cylinder
15 Inking system
16 Impression cylinder
17 Nip
18 Nip
19 Feed roller
20 Discharge roller
21 Cleaning device
22 Actuating grip
23 Cleaning body
24 Cleaning surface
25 Cleaning surface
26 Axis
27 Clamping device
28 Operator
29 Foot plate The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A cleaning device for guide rollers of a printing unit of a web-fed printing press, comprising:

a cleaning body; and an actuating grip, wherein the cleaning body is fastened to the actuating grip;

wherein the cleaning body is insertable between the guide rollers of the printing unit, wherein the cleaning body features cleaning surfaces on opposing sides that are adapted to a contour of the guide rollers, and wherein the cleaning surfaces on the opposing sides of the cleaning body have an identical concave contour.

2. The cleaning device according to claim 1, wherein the cleaning body is fastened to the actuating grip in an articulated manner.

3. The cleaning device according to claim 2, wherein an axis, around which the cleaning body is fastened to the actuating grip in the articulated manner, runs perpendicular to a longitudinal direction of the cleaning body as well as of the cleaning surfaces of the cleaning body.

4. The cleaning device according to claim 1, wherein the actuating grip engages on an upper section of the cleaning body and the cleaning surfaces are embodied on a lower section of the cleaning body.

5. The cleaning device according to claim 4 further comprising a clamping device, wherein the clamping device is allocated to the upper section of the cleaning body.

6. A web-fed printing press, comprising:

a first printing couple;

a second printing couple;

an impression cylinder engageable with the first and second printing couples;

a feed roller;

a discharge roller; and a cleaning device including a cleaning body and an actuating grip;

wherein the cleaning body is disposed between, and engageable with, the feed roller and the discharge roller, wherein the cleaning body includes cleaning surfaces on opposing sides that are complementary in form to a contour of the feed roller and the discharge roller.

7. The web-fed printing press according to claim 6, wherein a cleaning cloth that is wetted with a cleaning fluid is fastened to the cleaning body.

8. The web-fed printing press according to claim 6, further comprising a foot plate disposed above the feed roller and the discharge roller and wherein the actuating grip is disposed through the foot plate.

9. The web-fed printing press according to claim 6, wherein the cleaning body is rotatable about the feed roller and the discharge roller.

10. The web-fed printing press according to claim 6, wherein the cleaning body is rotatable about the actuating grip.

* * * * *